US007549617B1

(12) United States Patent
Schulze

(10) Patent No.: US 7,549,617 B1
(45) Date of Patent: Jun. 23, 2009

(54) SLAB SAVER FORM ATTACHMENT DEVICE

(76) Inventor: Todd M. Schulze, P.O. Box 4252, Mooresville, NC (US) 28117

( * ) Notice: Subject to any disclaimer, the term of this patent is extended or adjusted under 35 U.S.C. 154(b) by 0 days.

(21) Appl. No.: 12/019,663

(22) Filed: Jan. 25, 2008

(51) Int. Cl.
*B28B 7/22* (2006.01)

(52) U.S. Cl. ..... 249/91; 249/204; 52/127.1; 52/287.1; 264/271.1; 264/274; 264/275

(58) Field of Classification Search ..... 52/716.1, 52/718.01, 717.05, 254, 255, 256, 287.1, 52/288.1, 273, 601, 745.2, 745.11, 127.1, 52/699, 700, 800.11; 249/96, 97, 91, 38, 249/205; 264/271.1, 274, 275; 248/48.1, 248/48.2, 71, 74.2, 231.91, 234, 235, 250, 248/251

See application file for complete search history.

(56) References Cited

U.S. PATENT DOCUMENTS

| | | | | | |
|---|---|---|---|---|---|
| 760,999 | A * | 5/1904 | Landis | 404/8 |
| 1,209,713 | A * | 12/1916 | Kane | 404/8 |
| 2,678,482 | A * | 5/1954 | Cuthbertson et al. | 249/4 |
| 4,104,356 | A * | 8/1978 | Deutsch et al. | 264/297.9 |
| 4,127,974 | A * | 12/1978 | Wendt | 52/287.1 |
| 4,659,247 | A * | 4/1987 | Steiner | 404/8 |
| 5,337,534 | A * | 8/1994 | Nasca | 52/745.21 |
| 5,375,941 | A * | 12/1994 | Strobl, Jr. | 404/7 |
| 5,635,097 | A * | 6/1997 | Aiello | 249/38 |
| 5,829,213 | A * | 11/1998 | Schulze et al. | 52/254 |
| 5,830,378 | A * | 11/1998 | Butler | 249/18 |
| 2003/0126825 | A1 * | 7/2003 | Dai | 52/717.01 |
| 2004/0025450 | A1 * | 2/2004 | Gagliano | 52/169.9 |

* cited by examiner

*Primary Examiner*—Robert J Canfield
*Assistant Examiner*—Matthew J Gitlin
(74) *Attorney, Agent, or Firm*—Dennis G. LaPointe

(57) ABSTRACT

A concrete poured wall corner slab saver and form attachment device that includes a slab saver corner piece and an elongated form attachment device with a longitudinal aperture along an interior of its length. The form attachment device is configured at one end to be partially insertable through spaced-apart apertures in the stem portion of the slab saver corner piece and its opposite end is configured to extend and partially contact both a form board and one side of the corner piece which is in contact with the form board. The longitudinal aperture is size to insert a fastener, such as a nail, for engaging the combined slab saver corner piece and form attachment device to the form board.

5 Claims, 3 Drawing Sheets

SLAB SAVER FORM ATTACHMENT DEVICE

FIELD OF THE INVENTION

The present invention relates to a device for facilitating the installation of a corner slab saver for use as a pre-cast panel insert used to protect the surrounding areas, particularly the floors, while the pre-cast walls are being placed during tilt/wall construction.

DESCRIPTION OF THE PRIOR ART

During the construction and erection of concrete buildings by use of the method commonly referred to as "Tilt/Wall Construction", the movement of the wall units across the existing concrete floors for placement as building walls usually causes extensive damage to the building's concrete floor when the walls are moved and erected into place.

Typically, when tilt/wall construction is employed, each concrete wall is formed and poured on top of the building's concrete slab floor. After the wall has hardened, it is moved (i.e., tilted and slid along the floor) to its designated location. The sliding process generally results in significant scaring and damage to the concrete floor caused by the lower outside corner of the wall contacting the concrete floor. The resultant damage to the concrete floor must then be repaired at the expense of additional time, labor, materials, and associated costs.

One such slab saver device is that disclosed in U.S. Pat. No. 5,829,213, issued on Nov. 3, 1998 to Schulze et al., which is herein incorporated by reference.

The object of the present invention is to provide a device that significantly makes it easier to install the slab saver pieces, generally two or three segments along a wall edge, to the adjacent form board.

SUMMARY OF THE INVENTION

The present invention comprises a slab saver form attachment device. The slab saver is imbedded into the bottom outside corner of a concrete wall when the wall is formed and the attachment device, which is an elongated configured device, is used to attach the slab saver to an adjacent board used as a form. The attachment device attaches within one or more spaced-apart apertures in the stem of the slab saver and extends to one side of the slab saver with a longitudinal aperture along the interior of the attachment device through which a fastener, such as a nail, is inserted for nailing to the board. The nail and its aperture are lined up generally perpendicular to the side of the slab saver and above the side of the slab saver for direct nailing into the board. The attachment device is also configured to be in partial contact with the side of the slab saver device that is in contact with the form board. Nailing or fastening the attachment device to the form board with the end of the attachment device being in contact with both the form board and side of the slab saver device will keep the slab saver device firmly in position again the form board during the pouring of the concrete.

The attachment device could be made out of any material including, but not limited to, a synthetic resin material, a polypropylene material, a nylon material, a composite of a polymeric material or combinations of these materials, metal, iron, aluminum, etc., as all of it is embedded in the concrete and not exposed. Typically, an 8 penny nail is driven and bent over. During the bending it usually breaks the slab saver. When concrete is finished and hard there is no way to pull prior art device nails from the concrete. If the material on the attachment device is made soft enough and/or the head is small enough (small finish nail type of head), a construction worker is able to pull the nail completely out after casting the concrete.

Subsequently, when the wall is lifted tilted, and slid along the floor to its designated location, the slab saver is the only portion of the wall that comes in contact with the floor. The slab saver, because it is composed of a material that is softer than the concrete, protects the floor from damage. The board can then be removed and any portion of exposed nail can be snipped off or pulled out.

BRIEF DESCRIPTION OF THE DRAWINGS

In the accompanying drawings.

DETAILED DESCRIPTION OF THE INVENTION

Figure 3:
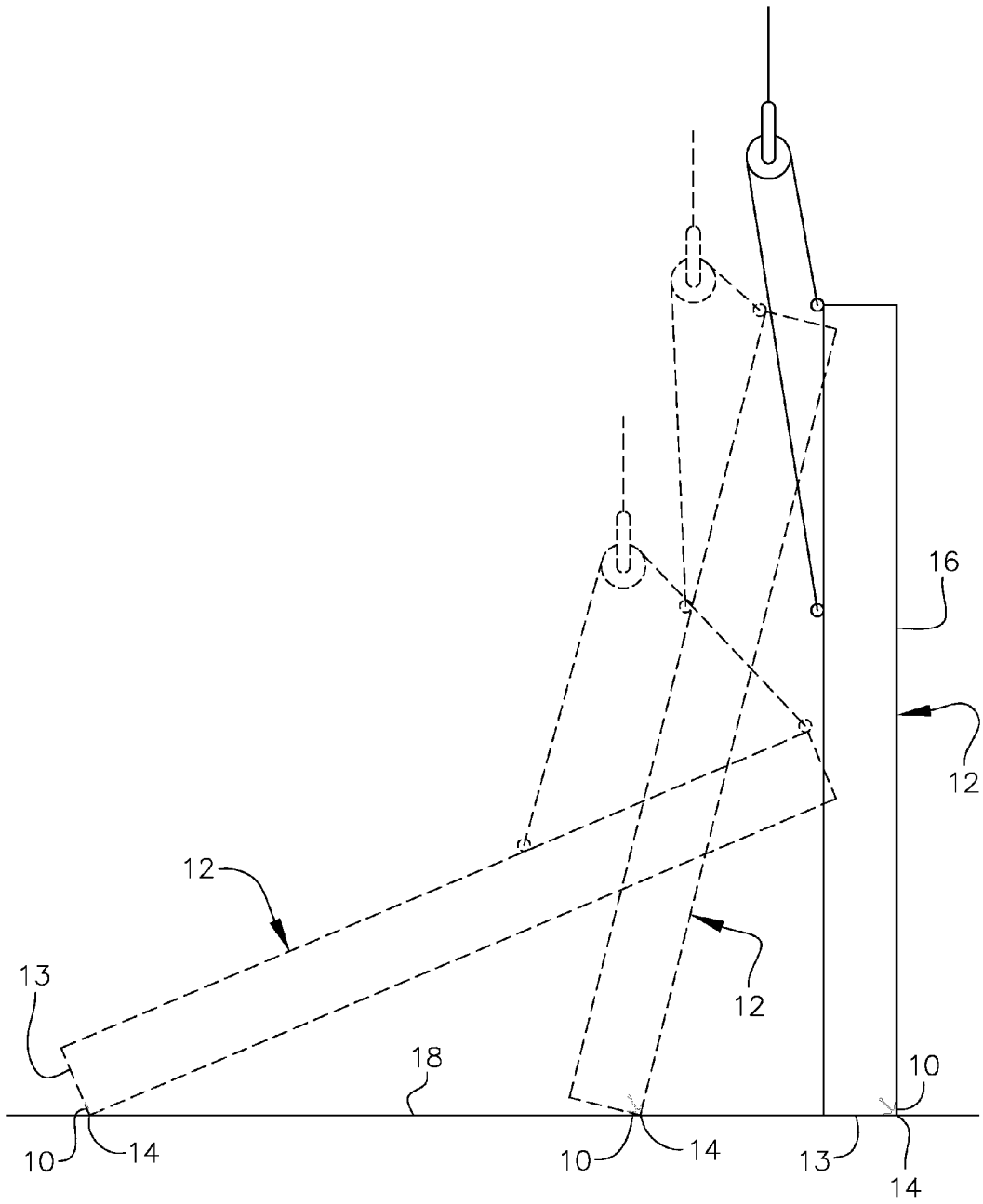
FIG. 3 is an end view conceptually depicting how a slab saver is incorporated into tilt/wall construction illustrating the process of lifting, tilting, and sliding the wall on the floor to its designated location.

In an effort to first describe the slab saver corner pieces, a slab saver 10 is typically used in 2-3 foot long segments along a corner 14 of a proposed concrete wall 12 to be poured. As shown in FIG. 3, it can be seen that the bottom outside corner 14 is in relation to the outside of the building, generally 16, when the wall 12 has been erected and FIG. 3 illustrates the placement and location of the slab saver 10 within the concrete wall 12. The slab saver corner pieces also include one or more spaced-apart apertures 42 along the length of the stem portion 30.

The slab saver 10 may be constructed of any material that exhibits the following characteristics: (1) is strong enough to withstand the weight of the concrete wall 12, in which the slab saver is inserted, without breaking when the wall 12 is tilted and slid into place; and (2) is softer than concrete, such that the slab saver 10 will not scratch, dent, or otherwise mar the surface of the concrete floor 18 when the corner 14 of the wall 12 is dragged along the floor 18 as the wall 12 is slid into place. When the concrete is cured, the wall 12 can be lifted, tilted, and slid on the slab saver 10 without damaging the floor. The slab saver 10 also acts as a permanent outside corner edge for the bottom 13 of the wall 12 once the wall 12 is positioned in its designated location.

Figure 1A:
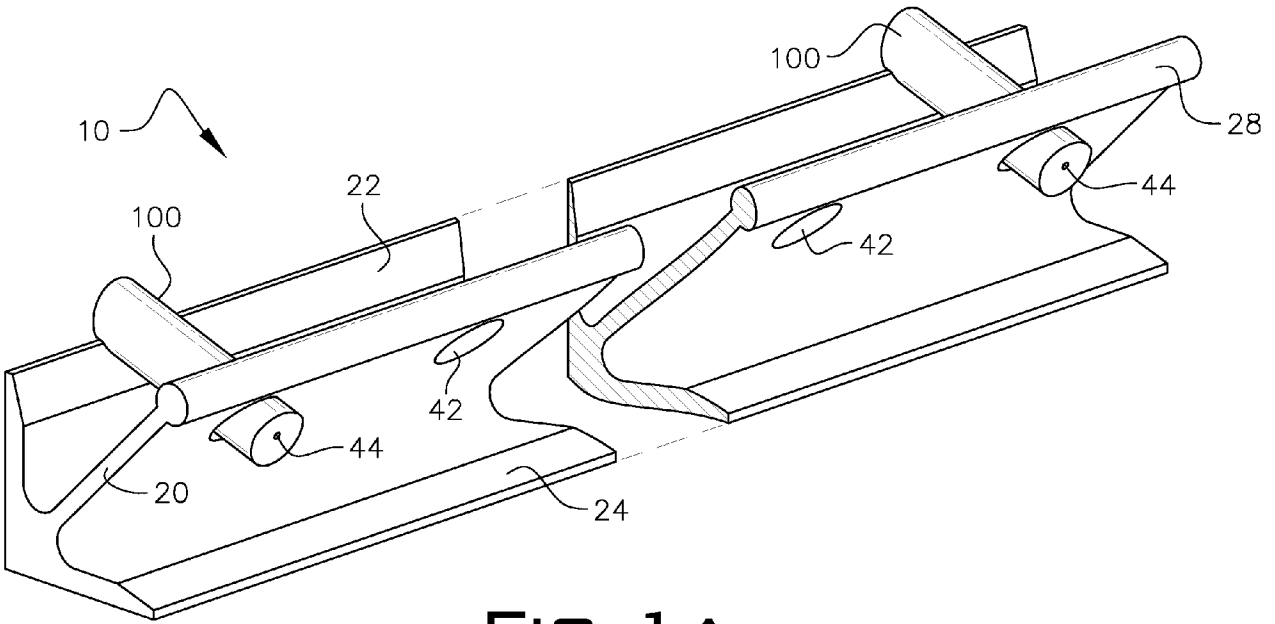
FIG. 1A is a conceptual exploded view of an example of the slab saver attachment device in relation to the slab saver itself.

The shape of a preferred embodiment of the slab saver 10 is illustrated in FIG. 1A, where it comprises a longitudinal member 20 that has a first side 22, a second side 24 and a generally central projection or stem 30. When view upside down, the slab saver 10 appears to be "T-shaped" with the upper part of the "T" being "roof-shaped" and forming respective sides 22 and 24. At an upper end of the stem portion 30 is an expanded portion 28 of the stem portion 30. This portion 28 can be T-shaped as well, such as illustrated in the drawings of U.S. Pat. No. 5,829,213 mentioned above. However, it is preferable that the expanded portion 28 be designed so as to mirror a ball shape at the upper end of the stem portion 30, with a diameter larger than the cross-section dimension of the stem portion 30. This will still maintain a general T-shape as illustrated in the above mentioned patent but the ball-shaped upper portion of the stem 30, which is still within the scope of the claims of the above mentioned patent, will provide for additional concrete contact surface to the slab saver 10.

The stem portion 30 with upper portion 28 forms a "KEY" in the concrete wall 12 which is used to secure the slab saver 10 firmly in place within the bottom outside corner 14 of the wall 12. The sides 22 and 24 of longitudinally extending member 20 will thus form the bottom outside corner 14 of the wall 12.

Figure 1C:
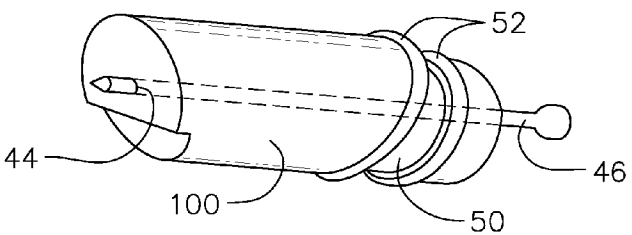
FIG. 1C is a conceptual representation of another example of the inventive slab saver attachment device.
Figure 1B:
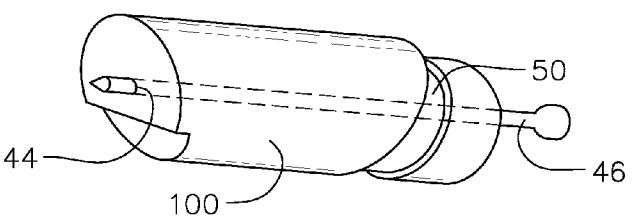
FIG. 1B is a conceptual representation of an example of the inventive slab saver attachment device.
Figure 2:
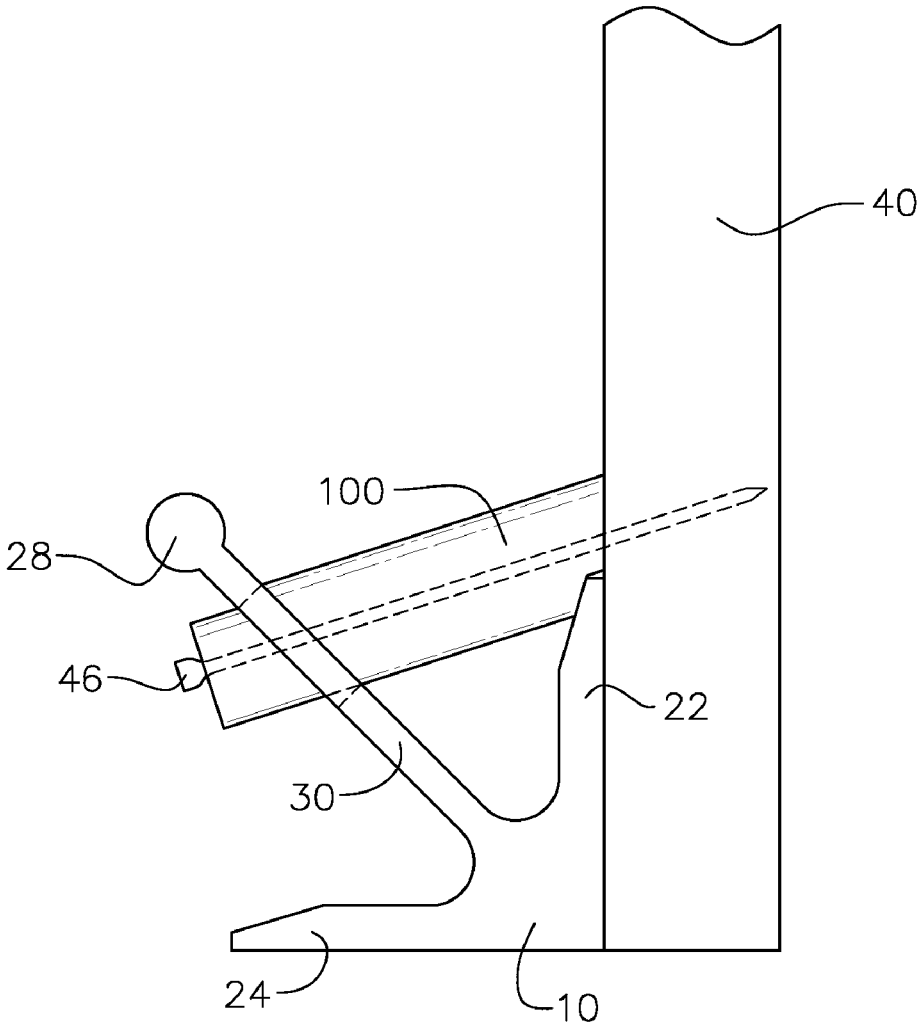
FIG. 2 is a cross-sectional view of the device of FIG. 1 illustrating the attachment device being nailed into a form board after engaged with the stem portion of the slab saver.

The invention includes means for attaching the slab saver corner piece 10 to a form board 40 used to pour concrete to form a wall slab 12, as shown in FIGS. 1B and 2. Preferably, this is a form attachment device 100, which is an elongated configured device that is used to attach the slab saver 10 to an adjacent board 40 used as a form. The attachment device 100 attaches within one or more spaced-apart apertures 42 in the stem 30 of the slab saver 10A and extends to one side 22 or 24 as appropriate, of the slab saver 10 with a longitudinal aperture 44 along the interior of the attachment device 100 through which a fastener 46, such as a nail, is inserted for nailing to the board 40. The nail and its aperture are lined up generally perpendicular to the side 22 or 24 of the slab saver 10 and above the side of the slab saver 10 for direct nailing into the board 40. The attachment device is therefore configured to be in partial contact with the side 22 or 24 of the slab saver device 10 that is in contact with the form board 40. Nailing or fastening the attachment device to the form board 40 with the end of the attachment device 100 being in contact with both the form board 40 and side 22 or 24 of the slab saver device will keep the slab saver device 10 firmly in position again the form board 40 during the pouring of the concrete.

As shown in FIGS. 1B and 1C, a preferred embodiment would also include either a notched portion 50 that generally circumvents the device 100, a couple of generally parallel ridges 52 that circumvent attachment device 100 or a combination of the ridges 52 and notch 50 in between the ridges 52. These additional features further enhance the ease of using the device 100 in that each device 100 can be snapped into holes 42 to help stabilize the device in place for nailing into the form 40 and during the concrete pouring phase.

The slab saver corner piece 10 is typically made from material that includes, but is not limited to, a synthetic resin material or a polypropylene material formulated to be softer than the concrete floor 18 over which the wall 12 is dragged.

The form attachment device 100 is typically made from material that includes, but is not limited to, a synthetic resin material, a polypropylene material, a nylon material, a composite of a polymeric material or combinations of these materials, metal, iron, aluminum, etc., as all of it is embedded in the concrete and not exposed.

The typical thickness or width of the attachment device is about ¼ inch to ½ inch depending on the material and nail size used. The size of the corner piece 10 is typically about 1.25 to 1.625 inches on the side with a stem portion 30 extending about 2.20 to 2.5 inches in length. The attachment device 10A is sized and configured to mate with the appropriate corresponding corner piece 10.

It should be understood that the preceding is merely a detailed description of one or more embodiments of this invention and that numerous changes to the disclosed embodiments can be made in accordance with the disclosure herein without departing from the spirit and scope of the invention. The preceding description, therefore, is not meant to limit the scope of the invention. Rather, the scope of the invention is to be determined only by the appended claims and their equivalents.

What is claimed is:

1. A concrete poured wall corner slab saver and form attachment device comprising:

a slab saver corner piece having a predetermined length and a first side and a second side, each side being generally perpendicular to each other with an inwardly directed central stem portion, the stem portion having an expanded portion at its distal end, which is larger in dimension than a thickness of the stem portion, the stem portion further having two or more spaced-apart apertures at predetermined locations along said stem portion;

means for attaching said slab saver corner piece to a form board used to pour concrete to form a wall slab, said means for attaching the slab saver corner piece being an elongated form attachment device with a longitudinal aperture along an interior of its length, said elongated form attachment device being configured at one end to be partially insertable through said spaced-apart aperture in said stem portion and its opposite end being configured to extend and partially contact both said form board and one of said first side or second side which is in contact with said form board; and said longitudinal aperture being size to insert a fastener for engaging the combined slab saver corner piece and form attachment device to said form board.

2. The concrete poured wall corner slab saver and form attachment device according to claim 1, wherein said slab saver corner piece is made from material comprising a synthetic resin material or polypropylene material formulated to be softer than said concrete floor over which the wall is dragged.

3. The concrete poured wall corner slab saver and form attachment device according to claim 1, wherein said form attachment device is made from material comprising a synthetic resin material, polypropylene material, nylon material, a composite of a polymeric material or combinations of said materials, metal, iron and aluminum.

4. The concrete poured wall corner slab saver and form attachment device according to claim 1, wherein said fastener is a nail.

5. The concrete poured wall corner slab saver and form attachment device according to claim 1, wherein said elongated form attachment device further comprises one of:

a notched portion near an end of said attachment device, said notched portion being configured to engage an inside perimeter within said spaced-apart aperture in said stem portion, a pair of spaced-apart ridges near an end of said attachment device, said spaced-apart ridges being configured to engage an inside perimeter of said spaced-apart aperture in said stem portion, and a combination of said notched portion and said pair of spaced-apart ridges.

* * * * *